US008539963B2

(12) United States Patent
Pires et al.

(10) Patent No.: US 8,539,963 B2
(45) Date of Patent: Sep. 24, 2013

(54) COSMETIC APPLICATOR

(75) Inventors: Leo Clifford Pires, Basking Ridge, NJ (US); Roger Hwang, Maple (CA); Rahul Bose, New Delhi (IN); Manisha Kohli, New Delhi (IN)

(73) Assignee: Zen Design Solutions Limited, Kowloon (HK)

( * ) Notice: Subject to any disclaimer, the term of this patent is extended or adjusted under 35 U.S.C. 154(b) by 89 days.

(21) Appl. No.: 13/152,919

(22) Filed: Jun. 3, 2011

(65) Prior Publication Data

US 2011/0297175 A1 Dec. 8, 2011

Related U.S. Application Data

(60) Provisional application No. 61/351,503, filed on Jun. 4, 2010.

(51) Int. Cl.
*A45D 40/26* (2006.01)
*A46B 11/00* (2006.01)

(52) U.S. Cl.
USPC ..... 132/218; 401/129

(58) Field of Classification Search
USPC ..... 132/218, 320, 216, 217, 318, 317, 132/120, 139, 142; 401/126, 127, 129, 279, 401/137, 261, 265, 266, 121; 15/172, 207.2, 15/159.1, 207, 206; D4/128, 127, 136, 133, D4/134
See application file for complete search history.

(56) References Cited

U.S. PATENT DOCUMENTS

| | | | | |
|---|---|---|---|---|
| 2,007,245 | A * | 7/1935 | Gimonet | 132/218 |
| 4,446,880 | A * | 5/1984 | Gueret et al. | 132/218 |
| 5,865,556 | A * | 2/1999 | Lhuisset | 401/290 |
| 6,053,179 | A * | 4/2000 | Lhuisset | 132/218 |
| 7,325,550 | B2 * | 2/2008 | Eckers et al. | 132/218 |
| 7,467,905 | B2 * | 12/2008 | Habatjou | 401/127 |
| 7,762,270 | B2 * | 7/2010 | De Brouwer et al. | 132/218 |
| D633,305 | S * | 3/2011 | Pires et al. | D4/128 |
| 8,141,561 | B2 * | 3/2012 | Thorpe et al. | 132/218 |
| 8,210,763 | B2 * | 7/2012 | Gueret | 401/129 |
| 2002/0011251 | A1 * | 1/2002 | Gueret | 132/218 |
| 2005/0236008 | A9 | 10/2005 | Gueret | |
| 2006/0216104 | A1 | 9/2006 | Bouix et al. | |
| 2006/0249171 | A1 * | 11/2006 | Kurek et al. | 132/218 |
| 2007/0033760 | A1 * | 2/2007 | Dumler | 15/187 |
| 2007/0062552 | A1 | 3/2007 | De Brouwer et al. | |
| 2007/0127974 | A1 * | 6/2007 | Chang et al. | 401/129 |
| 2008/0011317 | A1 * | 1/2008 | Malvar et al. | 132/218 |

(Continued)

OTHER PUBLICATIONS

PCT international search report and written opinion of PCT/US2011/033390 dated Jul. 8, 2011.

(Continued)

*Primary Examiner* — Vanitha Elgart
(74) *Attorney, Agent, or Firm* — Patterson & Sheridan, LLP

(57) ABSTRACT

The present invention generally relates to a cosmetic applicator and in particular, relate to a cosmetic applicator comprising of at least two molded applicator parts that are interlinked such that a non-zero angle is formed at an interface of the at least two molded applicator parts with respect to a centerline of the applicator. The cosmetic applicator of present invention imitates the twirl of the wrist during application and thereby provides a better application. The cosmetic applicator of the present invention may be used for cosmetic and care applications such as mascara application, hair coloring, lip application, etc.

13 Claims, 9 Drawing Sheets

(56) References Cited

U.S. PATENT DOCUMENTS

| | | | | |
|---|---|---|---|---|
| 2008/0083421 | A1* | 4/2008 | Malvar et al. | 132/218 |
| 2008/0219748 | A1* | 9/2008 | Salciarini | 401/129 |
| 2008/0245382 | A1 | 10/2008 | Marciniak-Davoult et al. | |
| 2009/0065020 | A1* | 3/2009 | Butcher et al. | 132/218 |
| 2009/0095317 | A1* | 4/2009 | Poetschl et al. | 132/320 |
| 2009/0114239 | A1* | 5/2009 | Chen | 132/218 |
| 2009/0193602 | A1* | 8/2009 | Dumler et al. | 15/160 |
| 2009/0276973 | A1* | 11/2009 | Bouix et al. | 15/206 |
| 2011/0048448 | A1* | 3/2011 | Legassie | 132/218 |
| 2011/0284021 | A1* | 11/2011 | Gueret | 132/218 |
| 2011/0297174 | A1* | 12/2011 | Ornoski et al. | 132/218 |
| 2012/0199158 | A1* | 8/2012 | Bickford | 132/218 |

OTHER PUBLICATIONS

PCT Notification Concerning Transmittal of International Preliminary Report on Patentability of PCT/US2011/033390 dated Dec. 4, 2012.

* cited by examiner

COSMETIC APPLICATOR

CROSS-REFERENCE TO RELATED APPLICATION

This application claims benefit of U.S. Provisional Application Ser. No. 61/351,503, filed Jun. 4, 2010, which is incorporated by reference in its entirety.

BACKGROUND

1. Field of the Invention

Embodiments of the present invention generally relate to a cosmetic applicator and in particular, relate to a cosmetic applicator comprising of at least two molded applicator parts that are interlinked such that a non-zero angle is formed at an interface of the two molded applicator parts with respect to a centerline of the applicator. The cosmetic applicator of present invention is able to imitate the twirl of the wrist during application and thereby provides a better application. The cosmetic applicator of the present invention may be used for cosmetic and care applications such as on skin or on keratinous fibers in the area of mascara application, lash care, nail care, mascara removal, lip application, hair coloring and hair repair etc.

2. Description of the Related Art

Conventionally, applicators include a stem, at one end of which is connected an applicator head and at the other end is provided a handle for gripping. Cosmetic applicator such as a mascara applicator deposits and distributes the product i.e. mascara all over the lashes. As mascara, inherently, is a product that is difficult to apply because of the sensitive target area of application, it is desirable that no clumping of product occurs and the lashes are separated and combed evenly. However, all the desired effects are not possible with a single mascara brush. This is because the eyelashes are soft, flexible, delicate and in close proximity to very sensitive eye tissue. Further, a user requires twisting and/or turning his/her hands in a particular manner to achieve a particular desired effect on the lashes and not all users are adept in being able to gradually twist their wrist along with the outward stroke of application on the lashes. Continuous innovations in this area are being made to provide the user with an applicator that gives him/her a better application and makes the whole application effortless to the consumer.

Mascara brushes that rotate during application are known. U.S. Pat. No. 4,056,111 describes a motor-driven, rotatable mascara brush. U.S. Pat. No. 4,397,326 describes a non-motorized mascara brush, the head of which is free to rotate and does so when the brush head contacts the eyelashes during application. It is the act of brushing that causes the rotation. However, the usage of these applicators is cumbersome for the user and some users find it frightening to use the battery-powered applicators.

There have also been innovations in the area of mascara applicators wherein the applicator is made in two parts having two different kinds of tines. U.S. Pat. No. 7,231,926 to RND Group LLC discloses a mascara brush, wherein a single brush rod of the mascara brush is formed with both an application brush part with an application portion for applying a mascara liquid to the eyelashes and an arrangement brush part with a comb for arranging the eyelashes in order to simultaneously perform the application of the mascara liquid and arrangement of the eyelashes.

United States Patent Application No. 20090193602 to Dumler, Nobert, discloses a cosmetic brush that has a multiplicity of tines that project out from a main body. A portion of the tines forms first tines that are integrally connected to the main body, wherein the first tines consist of the same first plastic material as the main body. Another portion of the tines forms second tines that are connected to the main body differently than the first tines. The main body has a main body wall provided with through holes, and the second tines are integrally connected to each other by means of a connecting member disposed on the side of the main body wall facing away from the second tines, and extend through the through holes, wherein the main body and the connecting member are immediately adjacent to each other and adhesively connected to each other. The main body is designed in the form of a hollow cylinder and integrally connected to a handle extension piece. The second tines are softer than the first tines.

United States Patent Application No. 20100083979 to RND group discloses a mascara brush that includes a bristle part for applying mascara to eyelashes, and a comb part for tidying the eyelashes. The bristle part and the comb part are integrally formed with a brush body through an injection molding process, such that the tines of the bristle part are thin and the comb teeth of the comb part are relatively thick.

If the product is applied using the aforementioned applicators then during application on the lashes the application brush would be followed subsequently by the comb part or vice versa and the user is expected to gradually blend the application with multiple such strokes, however, this creates a stark application.

It is found by the inventors of the present invention that an applicator if capable of imitating the twirling action of the hand results in better application of the product and therefore the user is provided with an even application and in case of mascara application there occurs no clumping as well as better separation of lashes. Further, it is desirable that if the applicator is containing two different kinds of tines or application surfaces, then the application becomes much more easier and relieves the user of using two different applicator one after the other to get a desired application. Therefore, there is a need in the art for an applicator that is able to imitate the twirling action of the wrist of the user during application thereby giving the desired effect without the user having to put in any effort.

SUMMARY

The present invention generally relates to a cosmetic applicator. More particularly, the invention relates to a cosmetic applicator comprising of at least two applicator parts that are interlinked such that a non-zero angle is formed at an interface of the two molded applicator parts with respect to a centerline of the applicator wherein the at least two applicator parts comprise a base body.

According to yet another embodiment of the invention the cosmetic applicator imitates the twirl of the wrist during application and thereby provides an expert like application even by a novice at make-up skills.

According to yet another embodiment of the present invention, there is provided an applicator wherein the at least two applicator parts comprise of two different materials. As an exemplary embodiment, in a mascara applicator, the at least two applicator parts may comprise a hard comb part and a soft bristle part.

According to yet another embodiment of the invention the base body of one of the at least two applicator parts has a cavity into which is interlocked a complementary profiled base body of the other applicator part. The cavity is such that the central longitudinal axis of the cavity lies away at a non-zero angle from the central longitudinal axis of the base body.

There is formed a non-zero angle X between the central longitudinal axis of the cavity of the at least one of the two applicator parts and the central longitudinal axis of the base body of the other applicator part interlocked into said cavity. Therefore, the at least two applicator parts are linked at a non-zero angle.

According to yet another embodiment of the invention the at least two applicator parts comprise an outer applicator part and an inner applicator part. The base body of the outer applicator part of a mascara applicator has a hollow cavity with the tines arranged on its circumference. The cavity is such that the central longitudinal axis of the cavity lies away at an angle from the central longitudinal axis of the base body. There is formed a non-zero angle X between the central longitudinal axis of the cavity of the outer applicator part and the central longitudinal axis of the base body of the inner applicator part. Further, the inner applicator part has a base body wherein the tines are arranged around the circumference of the base body and wherein the structure of the base body the inner applicator part is complimentary to the hollow cavity if the outer applicator part so that the inner applicator part fills the cavity of the outer applicator part thereby making a full applicator. Therefore, the two applicator parts are linked at a non-zero angle.

According to yet another embodiment of the invention there is provided a cosmetic applicator assembly comprising of a gripping member, a stem and an applicator as described above. The stem has a proximal end and a distal end. The proximal end of the stem is connected to the gripping member while the applicator is connected to the distal end of the stem.

In accordance with yet another embodiment of the invention the base body in a mascara applicator may have a plurality of tines extending from its circumference. According to an exemplary embodiment of the invention the tines on the base body of each part may extend out in parallel longitudinal rows. Alternatively the tines may extend radially parallel or in any other suitable arrangement. The at least two applicator parts comprise an outer applicator part and an inner applicator part. According to an embodiment of the invention the tines on the base body of the at least two applicator parts may be arranged in any suitable manner. Further, the tines may have any suitable length, width and density.

According to yet another embodiment of the present invention, during usage of the applicator due to the at least two applicator parts being interlinked at a non-zero angle, the set of tines from the two part applicator parts do not necessarily follow one behind the other on all the lashes at one go and the follow through is interspersed due to the twist, thus causing blending of the application by the two parts in the single stroke.

According to yet another embodiment of the invention the base body of said at least two applicator parts of the applicator is a doe foot. Cosmetic applicator of the present invention may be used for cosmetic and care applications on skin or on keratinous fibers such as for mascara application, hair coloring, lip application etc.

According to yet another embodiment of the present invention, an applicator for applying product is provided that includes a molded first applicator part having a first molded surface and a molded second applicator part having a second molded surface defined thereon. The molded second applicator part is coupled to the molded first applicator part to define at least a portion of an applicator tip. The first molded surface and the second molded surface of the molded first applicator part and the molded second applicator part respectively meets at an interface defined on an outer surface of the applicator tip. The interface has an orientation rotated about a center line extending axially through the applicator tip.

According to yet another embodiment of the present invention, an applicator for applying product is provided that includes a molded first applicator part having a first molded surface and a molded second applicator part having a second molded surface defined thereon. The molded second applicator part is coupled to the molded first applicator part to define at least a portion of an applicator tip. The coupling between the molded first and second applicator parts is such that a product delivery passageway is defined between said applicator parts via which the product or the composition can pass through. Further in the embodiment under consideration, the first molded surface and the second molded surface of the molded first and second applicator parts respectively meets at an interface defined on an outer surface of the applicator tip, wherein the interface has an orientation rotated about a center line extending axially through the applicator tip.

According to yet another embodiment of the present invention, an applicator for applying product is provided that includes a molded first applicator part having a first molded surface and a molded second applicator part having a second molded surface defined thereon. The molded second applicator part is coupled to the first applicator part to define at least a portion of an applicator tip. The first molded surface and the second molded surface of the molded first and the second applicator parts respectively meets at an interface defined on an outer surface of the applicator tip. Further in the embodiment under consideration, an aperture is formed through at the interface to define a product delivery passageway via which the product/composition can pass through the applicator. The interface has as an orientation rotated about a center line extending axially through the applicator tip.

In yet another embodiment of the invention, an applicator assembly is provided that includes an applicator coupled to a gripping member by a stem. The applicator includes at least two molded applicator parts that are interlinked such that a non-zero angle is formed at an interface of the two applicator parts with respect to a centerline of the applicator.

These and further aspects which will be apparent to the expert of the art are attained by a cosmetic applicator in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
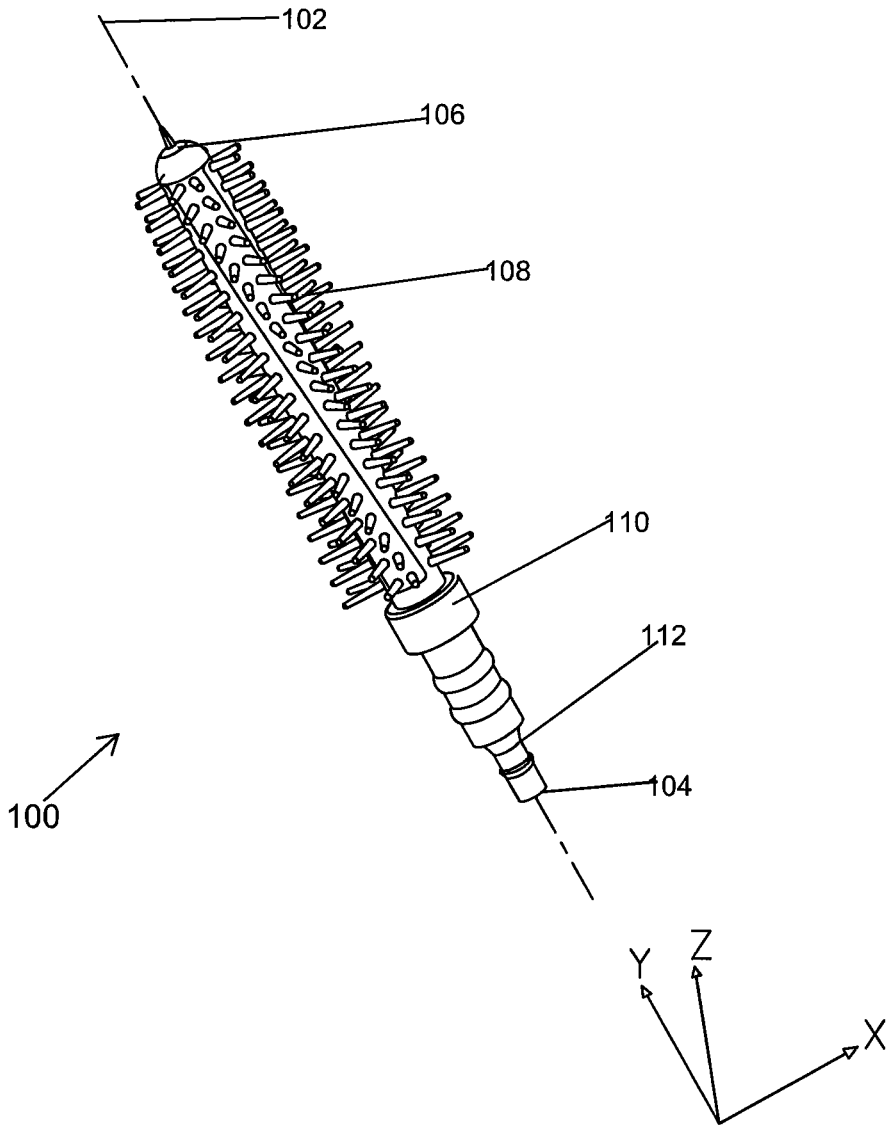
FIG. 1 illustrates an isometric view of the applicator according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

The applicator according to one embodiment of the present invention is shown in FIGS. 1 to 6.

FIG. 1 is one embodiment of the present invention showing an isometric view of a molded applicator 100. The applicator 100 is elongated along a center line 102 (e.g., the centre longitudinal axis), extending from proximate end 104 to a distal end 106. The applicator 100 includes an applicator tip 108 separated by a base 110 from a mounting portion 112. A portion of the center line 102 extending through the base 110 and mounting portion 112 may be linear, while a portion of the center line 102 extending through the applicator tip 108 may be linear, curved or have another geometry. In the embodiment depicted in FIG. 1, the center line 102 passes linearly through the base 110, applicator tip 108 and mounting portion 112.

Figure 2:
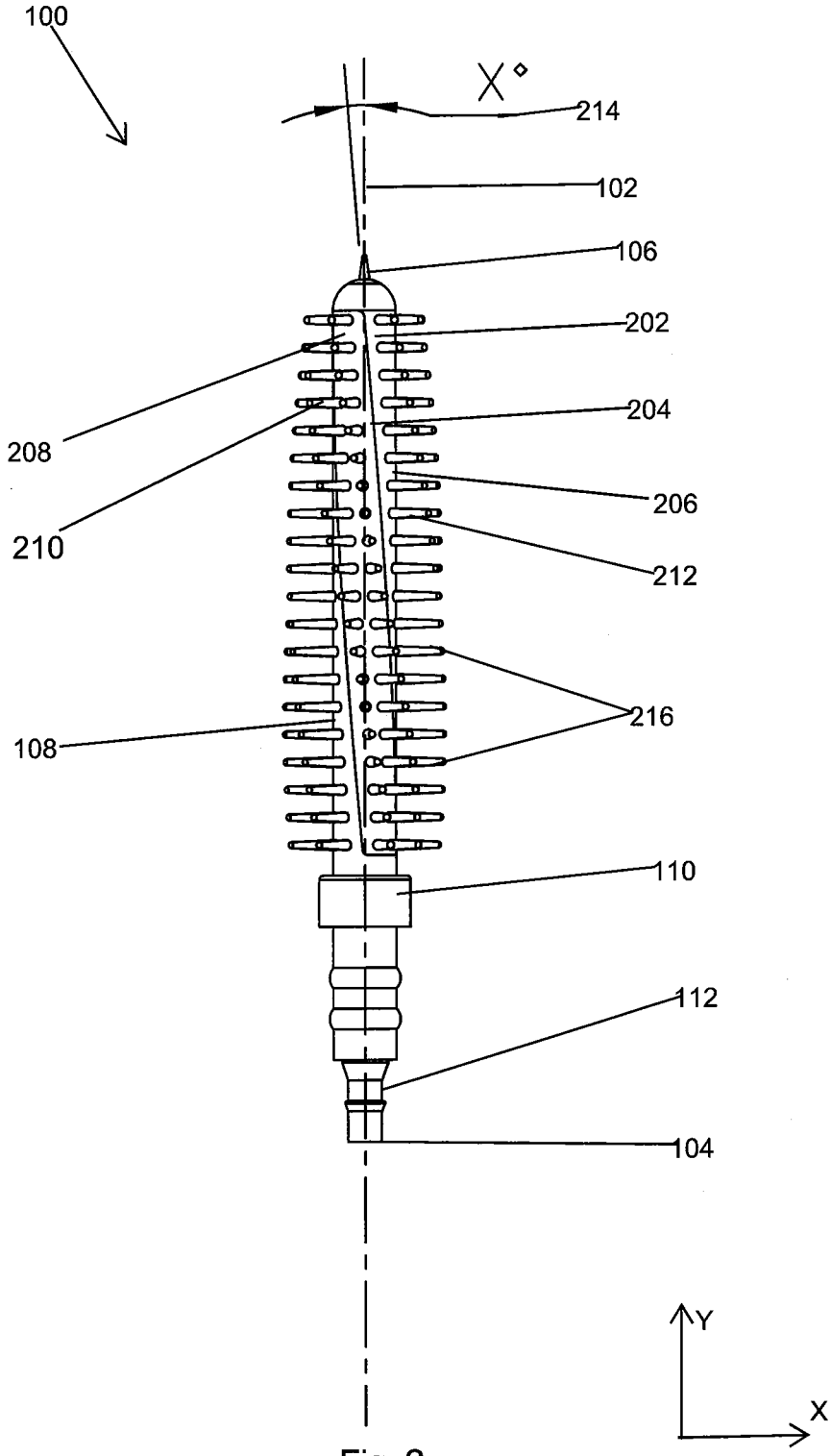
FIG. 2 illustrates a front view of the applicator of FIG. 1.

FIG. 2 is a front view of the applicator 100 illustrating the applicator tip 108 in greater detail. The applicator tip 108 is elongated (in the y-direction) and extends from the base 110 to the distal end 106 of the applicator 100. The shape of the elongated applicator tip 108 may be substantially cylindrical in form, but may optionally have a sectional profile (in the z/x plane) which is other than circular, for example, oval or polygonal, among other shapes. In the embodiment depicted in FIG. 2, the elongated applicator tip 108 has a cylindrical form.

The applicator tip 108 has an outer surface 202 that is formed from at least two surfaces formed from molded materials, shown in FIG. 2 as a first molded surface 206 and a second molded surface 208. The first and second molded surfaces 206, 208 may be aligned such that the outer surface 202 is substantially smooth and contiguous across an interface 204 of the surfaces 206, 208. The interface 204 of the surfaces 206, 208 is elongated (in the y-direction) and is rotated about the center line 102 of the applicator tip 108. The rotated interface 204 of the surfaces 206, 208 may define a twist, helix or other non-linear form. For example, at least one of the first and second molded surfaces 206, 208 rotate in the z/x plane as the surfaces 206, 208 extend from the base 110 toward the distal end 106. In this manner, at least one of the first and second molded surfaces 206, 208 has a helical form about the center line 102. In the embodiment depicted in FIG. 2, both surfaces 206, 208 have a congruent helical form about the center line 102 such that the interface 204 of the surfaces 206, 208 form a non-zero angle (shown by reference numeral 214) relative to the center line 102. In one embodiment, the non-zero angle 214 is about 55 to about 65 degrees, such as about 60 degrees. In other embodiments, the non-zero angle 214 may be greater than or less than 60 degrees. Alternatively, the molded surfaces 206, 208 may be elongated polygons such that the interface 204, although linear, still rotates about the centerline 102.

The first and second molded surfaces 206, 208 may also be fabricated from materials having different properties. The first molded surface 206 is fabricated from a material which is softer than a material from which the second molded surface 208 is fabricated. In one embodiment, the first molded surface 206 is fabricated from a material having a hardness of less than about 80 Shore D scale (ShD). In another embodiment, the second molded surface 208 is fabricated from a material having a hardness of greater than about 20 Shore D scale (ShD). It is also contemplated that the material of the first molded surface 206 may be harder than the material of the second molded surface 208. The different materials of the first and second molded surfaces 206, 208 may have properties that are attractive and non-attractive to mascara, have different stiffness, have different tactile feel, have different color, have different chemical nature, have different magnetic property, have different temperature property and/or other property. The combination of the different materials utilized for the first and second molded surfaces 206, 208, along with the rotational or twisting orientation of the surfaces 206, 208, allow the applicator 100 to mimic the twirl of the wrist during mascara application and thereby provides an expert like application even by a novice at make-up skills. Moreover, the hard material has been found to provide separation of the lashes during the application of mascara, while the softer material provides lift and volume. Thus, the unique twist of the hard and soft surfaces allows the softer surface to be followed by the harder surface so that mascara is applied to the lash in a manner that separates lifts and volumizes without expert manipulation of the applicator 100.

The first and second molded surfaces 206, 208 may also include a plurality of projections 216. The projections 216 may be attractive projections, and non-attractive projections, discs, and brush tines, among other properties and geometries. The projections 216, when present, may extend radially outward from the outer surface 202. In one embodiment, the projections 216 extend radially outward in a direction perpendicular to the outer surface 202.

In the embodiment depicted in FIG. 2, projections 216 from the first molded surface 206 form at least one longitudinal (i.e., substantially aligned with the center line 102) row of first brushes 210 while projections 216 from the second molded surface 208 form at least one longitudinal row of second brushes 212. The projections 216 forming the row of first brushes 210 may be integrally molded with the first molded surface 206, such that the rows of first brushes 210 have the same material property as the first molded surface 206. Likewise, the projections 216 forming the row of second brushes 212 may be integrally molded with the second molded surface 208, such that the rows of second brushes 212 have the same material property as the second molded surface 208. In this configuration, a substantially linear movement of the applicator 100 even without substantial rotation will engage the lash with rows of brushes 210, 212 having alternating physical properties, thereby enhancing the mimic of the twirl of the wrist during application. It is also contemplated that the material of the projections 216 may be different between rows, different within a row, and/or different than the material of the surface 206, 208 from which the projections 216 extend.

In one embodiment, the projections 216 forming each row of brushes 210, 212 are aligned and extend substantially perpendicular to the outer surface 202. The projections 216 forming the first row of brushes 210 may be congruent to the projections 216 forming the second row of brushes 212. In the embodiment depicted in FIG. 2, the first molded surface 206 includes projections 216 forming the two congruent helical rows of defining two first rows of brushes 210, while the second molded surface 208 includes projections 216 forming the two congruent helical rows of defining two second rows of brushes 212, wherein the rows of brushes extending from the first molded surface 206 are congruent with the rows of brushes extending from the second molded surface 208. Thus, the rows of brushes 210, 212 may define congruent rows orient at a non-zero angle relative to the center line 102 of the applicator 100, for example as illustrated by the angle 214 shown in FIG. 2.

The outer surface 202 may be fabricated by molding or other suitable technique. In one embodiment the first molded surface 206 and second molded surface 208 are separately molded, then assembled. In another embodiment, the first molded surface 206 may be over molded on the second molded surface 208. It is contemplated that other fabrication techniques may be utilized.

Figure 3:
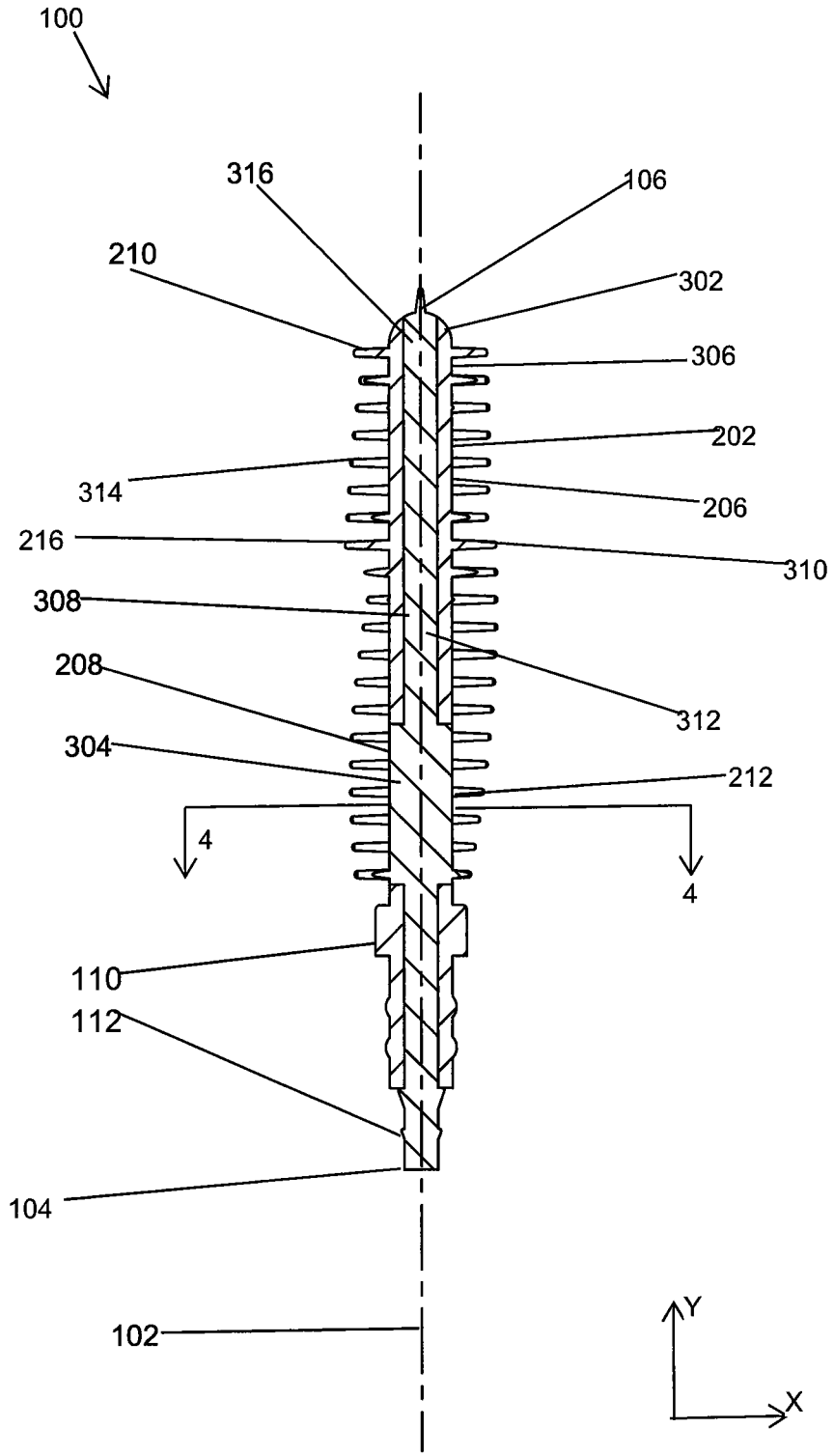
FIG. 3 illustrates a sectional view of the applicator of FIG. 2.
Figure 4:
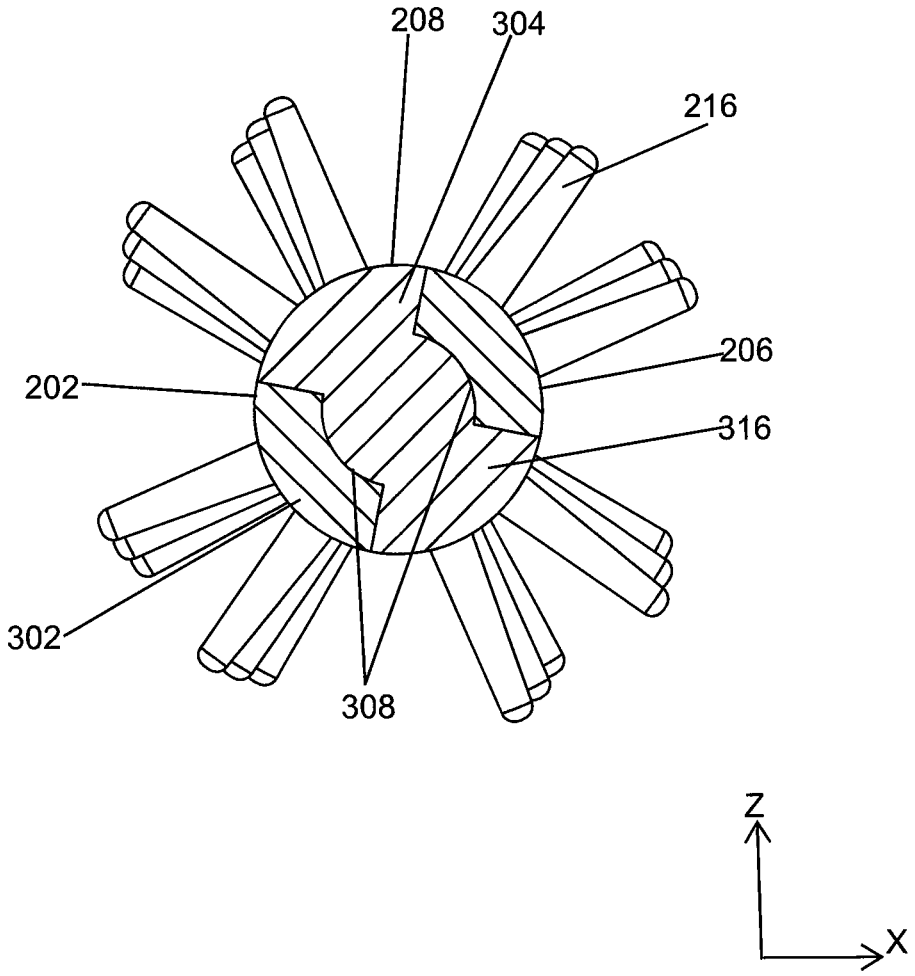
FIG. 4 illustrates a sectional view of the applicator of FIG. 2 taken along section line 4-4 of FIGS. 2, 3.

FIGS. 3-4 are sectional views of the applicator 100. The applicator 100 includes an outer applicator part 302 and an inner applicator part 304. The applicator parts 302, 304 are molded from different polymers or two polymers having different physical properties. The materials suitable for forming the applicator parts 302, 304 (i.e., and consequently the surfaces 206, 208) include porous rubber, non-porous rubber, fabric mesh, felt material, foamed polymers, sponge material, thermoplastic, thermoplastic elastomer (TPE), metal and its composites, ceramic, nylon, or any other suitable material.

The outer applicator part 302 comprises of a base body 306 that has a hollow cavity 308, and on the outer circumference of the base body 306 is defined by the first molded surface 206, which in one embodiment, include projections 216 arranged as a plurality of tines 310 extending out from said base body 306. The base body 306 includes at least one elongated window 316 that exposes the hollow cavity 308 through the first molded surface 206.

The inner applicator part 304 has a base body 312 which is complimentary and snug fits within the hollow cavity 308 of the outer applicator part 302. The base body 312 of the inner applicator part 304 has an outer circumference defined by the second molded surface 208, which in one embodiment include projections 216 arranged as a plurality of tines 314 extending out from said base body 312. The second molded surface 208 of the base body 312 extends through the window 316 of the base body 306 such that the first molded surface 206 and second molded surface 208 align to define the outer surface 202 of the applicator 100.

Further, the applicator parts 302, 304 may be suitably connected with each other to expose the rows of projections 216 of each of the applicator parts in a suitable arrangement. As shown, the applicator parts 302, 304 are so arranged to expose the projections 216 of each of the applicator parts 302, 304 in a common x-z plane. Alternatively, adjacent projections 216 in each of the applicator parts 302, 304 may be in different x-z planes.

Figure 5:
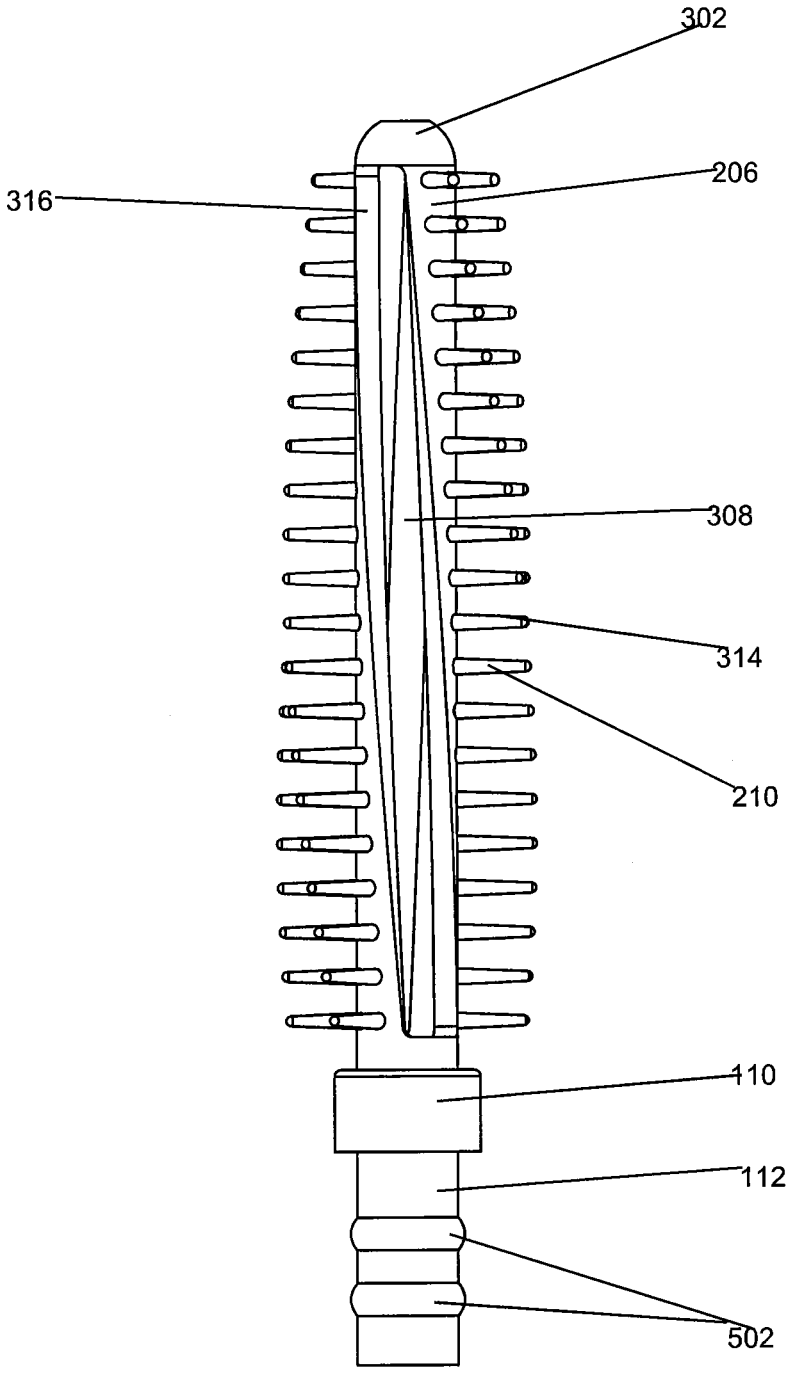
FIG. 5 illustrates the outer applicator part of the applicator of FIG. 1.

FIG. 5 is a front view of one embodiment of the outer applicator part 302. In the embodiment of FIG. 5, the outer applicator part 302 includes two elongated windows 316 arranged in a congruent helical orientation about the center line 102. Thus, the two windows 316 may be congruent helixes and be oriented at a non-zero angle relative to the center line 102 of the applicator 100, for example as illustrated by the angle 214 shown in FIG. 2.

The outer applicator part 302 also includes one or more engagement features 502, such as a groove or ridge, extending outward from the base body 306 to facilitate coupling the applicator 100 to a stem of an applicator assembly, as discussed further below.

Figure 6:
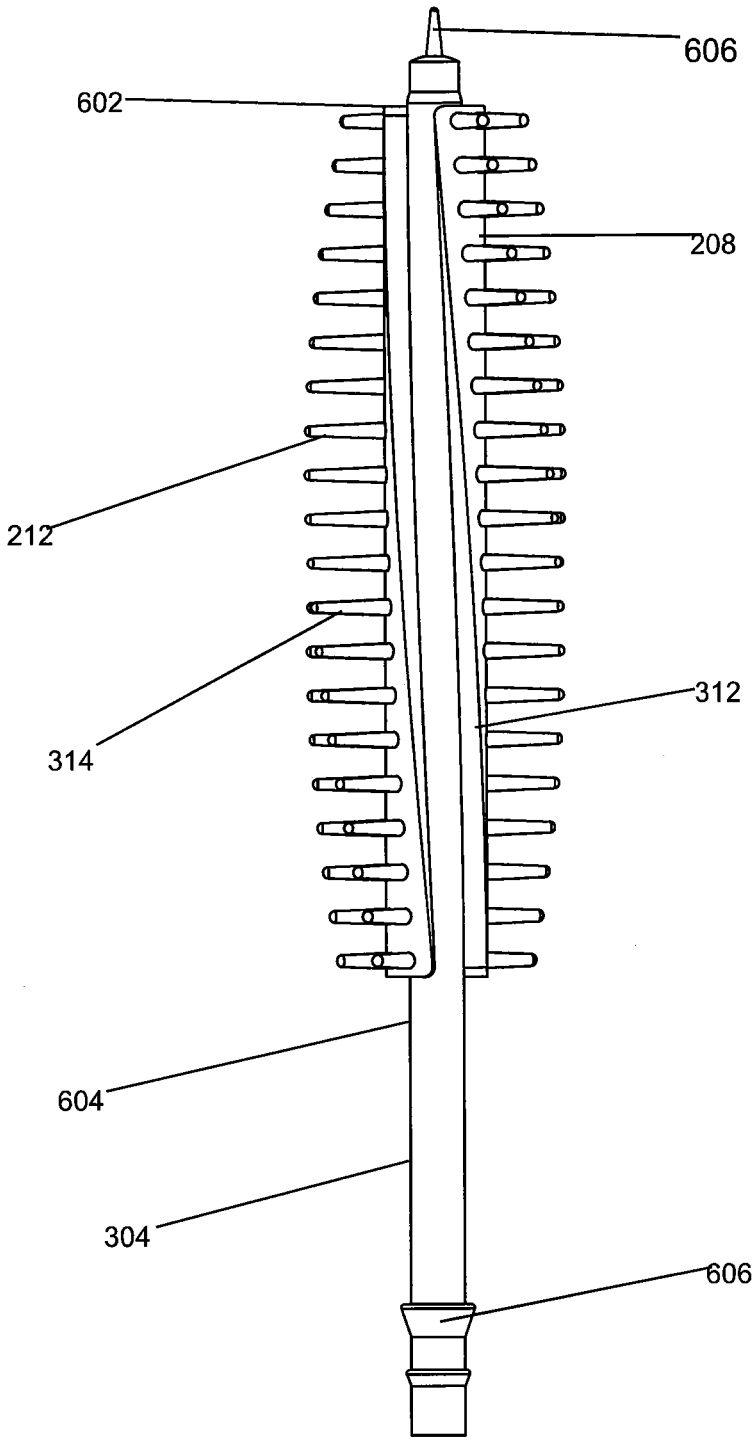
FIG. 6 illustrates the inner applicator part of the applicator of FIG. 1.

FIG. 6 is a perspective view of the inner applicator part 304. In the embodiment of FIG. 6, the base body 312 includes two ridges 602 extending radially from a central rod 604. The two ridges 602 twist about the central rod 604 in a helical orientation that mates with and extends through the helical windows 316 of the outer applicator part 302 as shown in FIG. 4. Thus, the two ridges 602 match the orientation of the windows 316 and are thereby oriented a non-zero angle relative to the center line 102 of the applicator 100, for example as illustrated by the angle 214 shown in FIG. 2. It is contemplated that the number of windows 316 and mating ridges 602 may vary.

The central rod 604 ends in a barb 606 like feature that is axially spaced from the ridges 602. The barb 606 is orientated to allow the central rod 604 to pass through the hollow cavity 308 and exit the outer applicator part 302 at the proximate end 104 of the applicator 100 to lock the inner applicator part 304 within the outer applicator part 302.

Returning to FIG. 2 and as discussed above, the plurality of projections 216 may be made of different materials so as to give multiple effects in a single application of mascara. The projections 216 extending from a respective surface 206, 208 may be made of soft and hard materials or vice versa. Further, the projections 216 may be arranged on the surfaces 206, 208 and inner applicator part 304 respectively in any suitable manner. Further, the projections 216 may have any suitable length, width/thickness and density.

Figure 7:
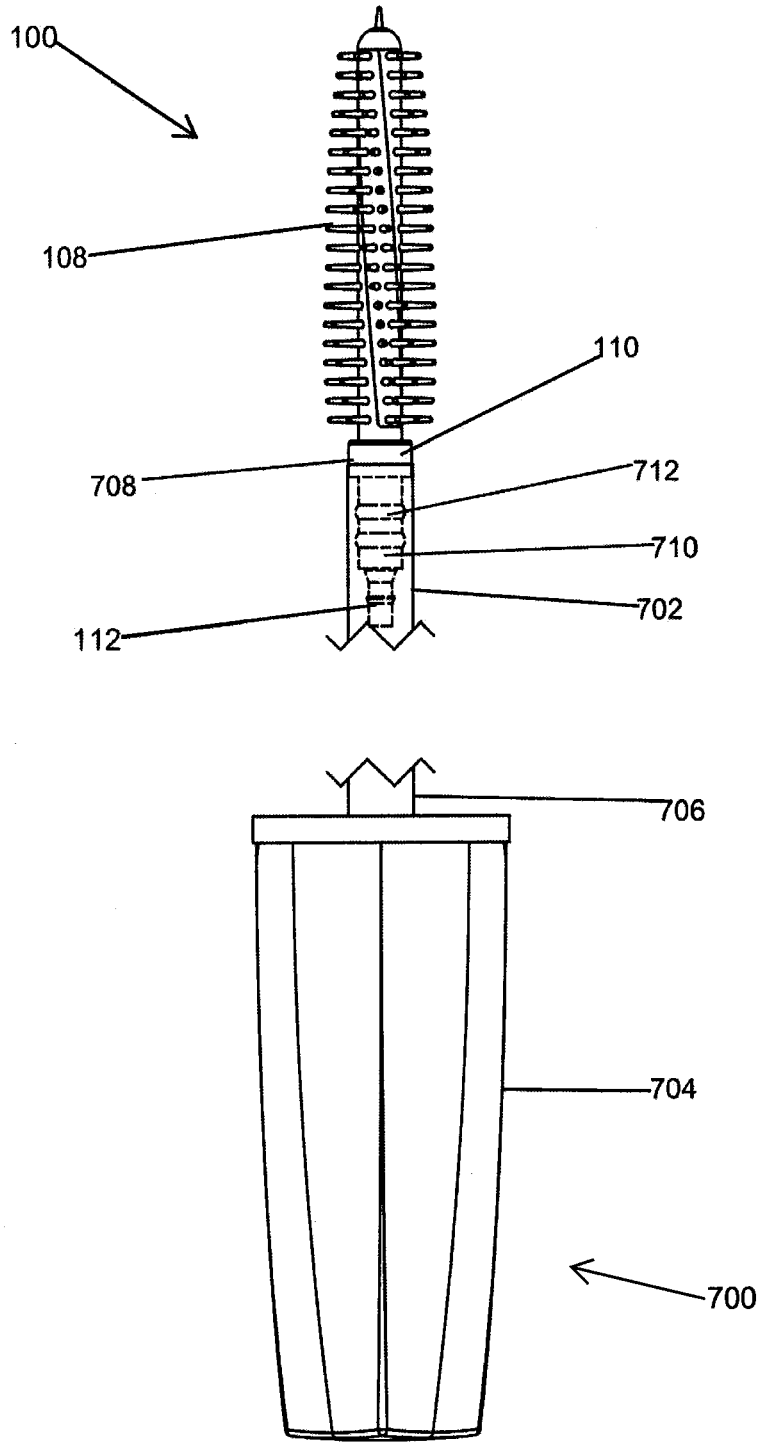
FIG. 7 illustrates the isometric view of an applicator assembly comprising the applicator according to an embodiment of the present invention.

FIG. 7 illustrates another embodiment of the present invention. As shown in the FIG. 7, an applicator assembly 700 includes an applicator 100 as described above, a stem 702 and a gripping member 704. The stem 702 has a proximal end 706 and a distal end 708. The proximal end 706 of the stem 702 is connected to the gripping member 704, while the applicator 100 is connected to the distal end 708 of the stem 702. Although the applicator 100 may be connected to the distal end 708 of the stem 702 in any suitable manner, in the embodiment depicted in FIG. 7 the distal end 708 of the stem 702 includes a hollow bore 710 which receives the mounting portion 112 of the applicator 100. The hollow bore 710 includes one or more undercuts or grooves 712 which engage with the engagement features 502 of the outer applicator part 302 to secure the applicator 100 to the stem 702. Alternatively, the applicator 100 may be connected to the distal end 708 utilizing plastic welding techniques, adhesives or other suitable fastening technique.

Figure 8:
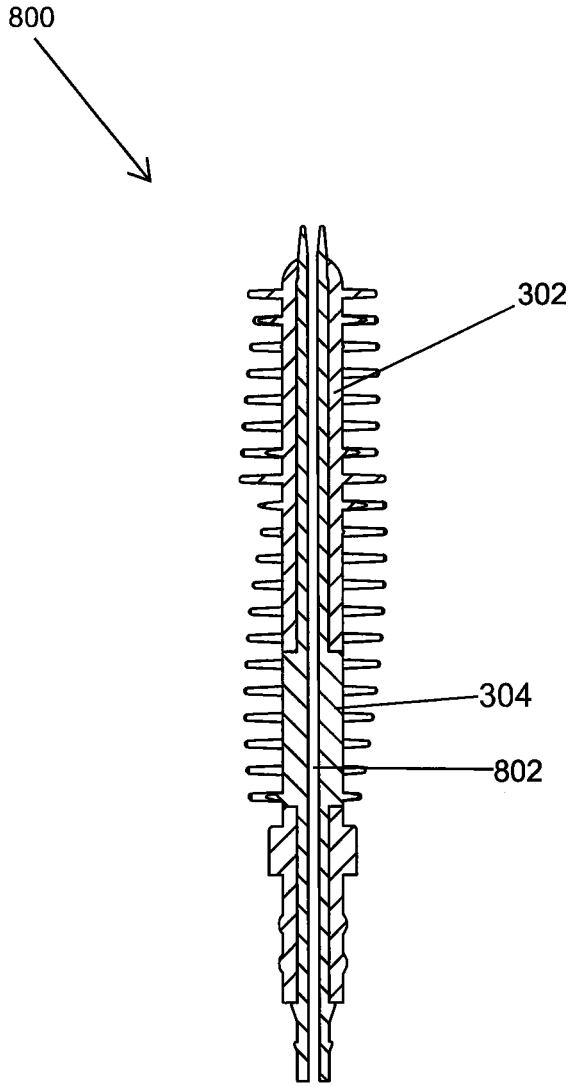
FIG. 8 illustrates a sectional view of the applicator according to another embodiment of the present invention.

FIG. 8 illustrates another embodiment of the present invention. The applicator 800 is substantially similar to the applicator 100 described above, except in that a product delivery passage/channel 802 is defined within the inner applicator part 304 of the applicator 800 via which the product/composition can pass through. Alternatively, the channel 802 in the applicator 800 via which the product can pass through may be defined within the outer applicator part 302 of the applicator 800.

Figure 9:
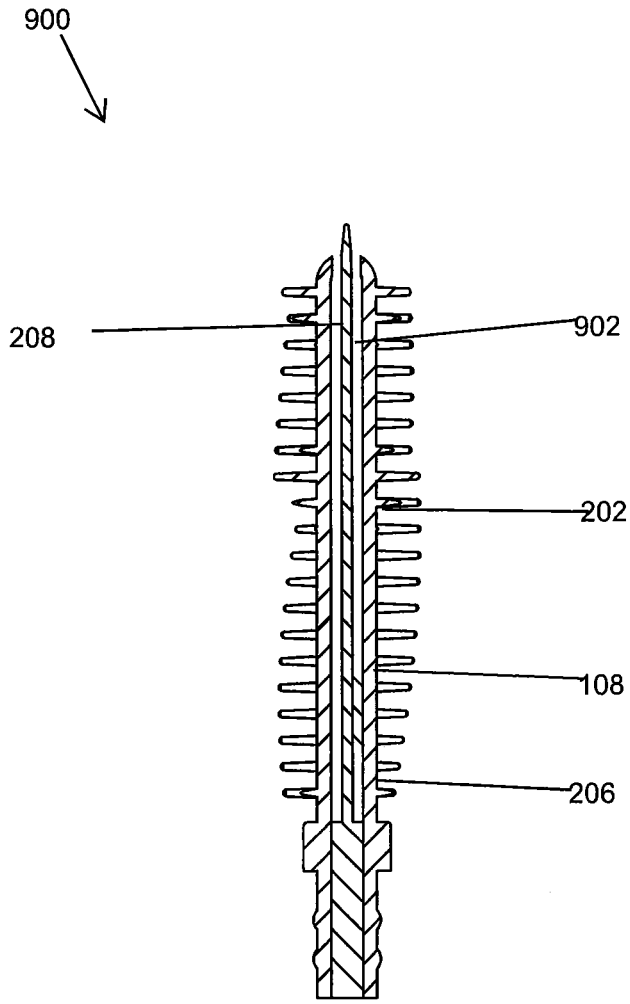
FIG. 9 illustrates a sectional view of the applicator according to yet another embodiment of the present invention.

FIG. 9 illustrates another embodiment of an applicator 900. The applicator 900 is substantially similar to the applicator 100 described above, except in that at least one aperture 902 is formed through the outer surface 202 of the applicator tip 108 that is formed from at least two surfaces formed from molded materials, as a first molded surface 206 and a second molded surface 208. The first and second molded surfaces 206, 208 may be aligned such that the outer surface 202 is substantially smooth and contiguous across an interface 204 of the surfaces 206, 208. The aperture 902 formed through at the outer surface 202 allows the product/composition to pass through the applicator 900. It is also contemplated that a hole, a slot, and the like may be formed through at the outer surface 202 of the first and second molded surfaces 206, 208.

While the foregoing is directed to embodiments of the present invention, other and further embodiments of the invention may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. An applicator for applying product, said applicator comprising:

a molded first applicator part having a first molded surface defined thereon; and a molded second applicator part coupled to the first applicator part to define at least a portion of an applicator tip, the second applicator part having a second molded surface defined thereon, the first molded surface and the second molded surface meeting an interface defined on an outer surface of the applicator tip, the interface having an orientation rotated about a center line extending axially through the applicator tip; and the first molded surface and the second molded surface are aligned such that the outer surface formed by the first molded surface and the second molded surface is smooth and contiguous across the interface; and wherein the first applicator part further comprises: a base body having a hollow cavity and at least one elongated window that exposes the hollow cavity through the first molded surface.

2. The applicator of claim 1, wherein the first and second applicator parts are comprised of different materials.

3. The applicator of claim 2, wherein the material comprising the first applicator part is softer than the material comprising the second applicator part.

4. The applicator of claim 2, wherein the material comprising the first and second applicator parts have a different property selected from the group consisting of color, magnetism, and temperature.

5. The applicator of claim 1, wherein a plurality of interfaces are defined between a plurality of applicator parts defining the applicator tip, the plurality of applicator parts including at least the first and second applicator parts, the interfaces having an orientation rotated about the center line extending axially through the applicator tip.

6. The applicator of claim 1, wherein the second applicator part further comprises: a base body disposed in the hollow cavity and having the second molded surface defined thereon, the second molded surface of the base body of the second applicator part extending through the window of the base body of the first applicator part.

7. An applicator for applying product, said applicator comprising:

a molded first applicator part having a first molded surface defined thereon; and a molded second applicator part coupled to the first applicator part to define at least a portion of an applicator tip, the second applicator part having a second molded surface defined thereon, the first molded surface and the second molded surface meeting an interface defined on an outer surface of the applicator tip, the interface having an orientation rotated about a center line extending axially through the applicator tip; and the first molded surface and the second molded surface are aligned such that the outer surface formed by the first molded surface and the second molded surface is smooth and contiguous across the interface; wherein the first applicator part further comprises:

a base body having a hollow cavity having an orientation rotated about the center line extending axially through the applicator tip; and at least one elongated window that exposes the hollow cavity through the first molded surface.

8. The applicator of claim 7, wherein the second applicator part further comprises: a base body disposed in the cavity and having the second molded surface defined thereon, the second molded surface of the base body of the second applicator part extending through the window of the base body of the first applicator part such that the first and second molded surfaces align to form the interface.

9. The applicator of claim 7, wherein the at least one window comprises two elongated windows having a congruent helical orientation.

10. The applicator of claim 1 further comprising: at least one longitudinal row of first brushes extending from the first molded surface; and at least one longitudinal row of second brushes extending from the second molded surface.

11. The applicator of claim 10, wherein the rows of first and second rows brushes are rotated about the center line.

12. The applicator of claim 10, wherein the rows of first and second rows brushes each have a tine oriented on a common plane perpendicular to the center line.

13. The applicator of claim 1, wherein the first applicator part has a profile complimentarily to the second applicator part, wherein the second applicator part is interlocked within a cavity of the first applicator part.

* * * * *